US006401255B1

(12) United States Patent
Douglas

(10) Patent No.: US 6,401,255 B1
(45) Date of Patent: Jun. 11, 2002

(54) THREE-CORNERED HEAD COVERING WITH PONY TAIL OPENING

(76) Inventor: Bradley C. Douglas, 2115 39th St., Des Moines, IA (US) 50310

( * ) Notice: Subject to any disclaimer, the term of this patent is extended or adjusted under 35 U.S.C. 154(b) by 0 days.

(21) Appl. No.: 09/752,196

(22) Filed: Dec. 29, 2000

(51) Int. Cl.[7] ..... A42B 5/00
(52) U.S. Cl. ..... 2/207; 2/918
(58) Field of Search ..... 2/202, 204, 205, 2/207, 171, DIG. 11, 909

(56) References Cited

U.S. PATENT DOCUMENTS 5,321,854 A * 6/1994 Kronenberger ..... 2/209.7
5,598,585 A * 2/1997 Stroup ..... 2/171
5,685,016 A * 11/1997 Douglas ..... 2/171
5,799,334 A * 9/1998 Griffith et al. ..... 2/195.1
5,875,488 A * 3/1999 Milani ..... 2/12
D424,282 S * 5/2000 Crumpton et al. ..... D2/876
6,247,181 B1 * 6/2001 Hirsch et al. ..... 2/207

* cited by examiner

*Primary Examiner*—Peter Nerbun
*Assistant Examiner*—Katherine Moran
(74) *Attorney, Agent, or Firm*—Henderson & Sturm LLP

(57) ABSTRACT

A head covering made of a flexible material member wherein the flexible material member includes an inside surface, an outside surface and at least three corners. A first portion of the flexible material member is formed between the first corner and the second corner and is inclusive of the first and second corner. A first fastener is used to secure the first corner in close proximity to the second corner. A second fastener is used to secure the third corner to the first portion. In another embodiment disclosed, a first fastener is used to connect the first corner to the third corner and a second fastener is used to connect the second corner to the third corner. In both embodiments, an opening is provided to receive a pony tail therethrough.

5 Claims, 2 Drawing Sheets

THREE-CORNERED HEAD COVERING WITH PONY TAIL OPENING

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates generally to apparel worn on the head and specifically to a head covering which includes three corners and fasteners to secure the head covering around the head of the wearer.

2. Background Art

Head coverings, or head wear, typically are designed to satisfy various functions including fashion, protection, sweat absorption, and heat retention. The prior art consists of many varieties of head coverings which to various degrees satisfy one or more of the previously mentioned functions. Many athletes are required to wear a head covering as part of the uniform. These head coverings typically satisfy the functions of fashion and protection but often do not provide satisfactory sweat absorption.

Many type of head coverings exist which are primarily used for sweat absorption. The simplest of these is the head band. The head band is usually made out of an elastic material which is stretched around the head, made in various sizes, or made with an adjustable fastener such as a hook and loop fastener. While head bands provide for sufficient sweat absorption, they are not stable when worn under other head coverings.

One popular head covering worn by many athletes is a folded bandanna. The folded bandanna forms a triangle and the three corners are tied together typically in the back of the head. This head covering covers the entire top portion of the head, provides for good sweat absorption, and is stable when worn under other head coverings. However, there are two drawbacks to this type of head covering. First, the act of tying the three corners together can be time consuming. This may be a problem if the head gear is knocked off of an athlete's head during the action of an athletic event. Second, the knot formed by typing the three corners together can be very uncomfortable under the other head covering. This is especially true when the head covering is a rigid type head covering used for protection such as a football helmet.

U.S. Pat. No. 5,685,016 solves many of these problems, but there remains a problem if the user has a pony tail and wishes to have it extend out the back of the bandana.

Thus, there is a need for a head covering which satisfied the need for sweat absorption, which is easy to wear, which is stable when worn, and which uses fasteners which maintain comfort even when worn under other head wear such as head wear which is part of an athletic uniform and also has a provision to allow a pony tail to extend out the back thereof.

BRIEF SUMMARY OF THE INVENTION

The present invention relates generally to apparel worn on the head and specifically to a head covering which includes three corners and fasteners to secure the head covering around the head of the wearer. The head covering of the present invention is made of a flexible material. The flexible material includes an inside surface and an outside surface. The flexible material includes at least three corners. A first portion of the flexible material is formed between a first corner and a second corner and includes the first and second corners.

A first fastener is used to connect the first corner to the second corner when the first portion is wrapped around the head of he wearer. A second fastener is used to connect the third corner to the first portion. The second connection is made when the wearer wraps the third corner of the head cover over the top of he wearer's head after the first connection has been made. This connection is typically made in close proximity to the connection between the first and the second corner. This third corner can be split to allow a pony tail to extend therethrough with fasteners on each part of the split third corner. In another embodiment a hole is provided in the third corner to allow a pony tail to extend therethrough.

The fasteners are hook and loop fasteners in a preferred embodiment. In another embodiment, snaps are used.

An object of the present invention is to provide an improved head covering with structure to allow a pony tail to extend therethrough.

Other objects, advantages, and novel features of the present invention will become apparent from the following detailed description of the invention when considered in conjunction with the accompanying drawings.

DETAILED DESCRIPTION OF THE INVENTION

Figure 1:
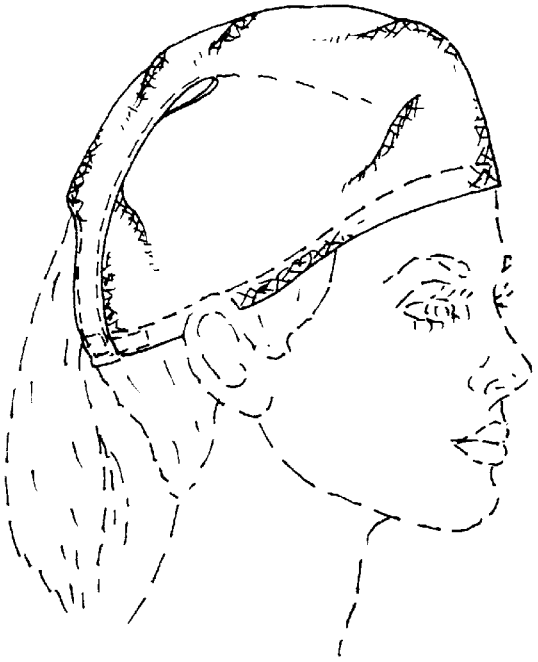
FIG. 1 is a side perspective view of the three-cornered head covering constructed in accordance with the present invention.

To assist in a better understanding of the invention, a description of different forms and embodiments of the invention will now be described in detail. Reference will be made to the accompanying drawings. Reference numbers and letters will be used in the drawings to indicate specific parts and locations on the drawings. The same reference numerals and letters will be used throughout the drawings unless otherwise indicated. It is to be understood that the scope of the invention is not limited to the specific embodiments discussed herein.

Figure 3:
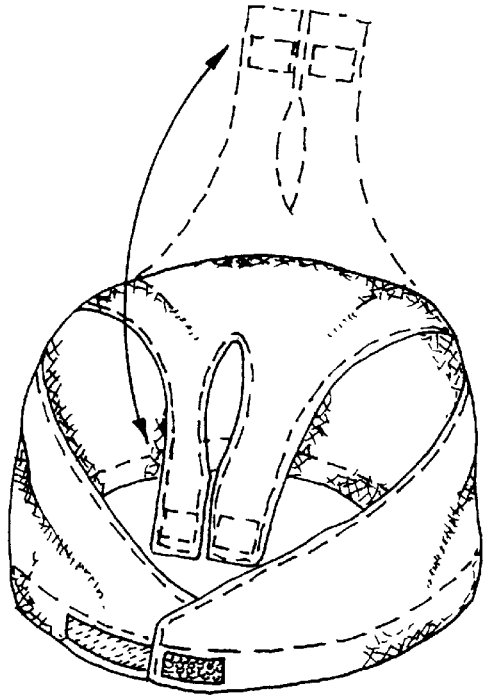
FIG. 3 is a back perspective view of a preferred embodiment of the three-cornered head covering built in accordance with the present invention with the back fastened with the top in the process of moving from the dashed line view to the solid line view and ultimately to the FIG. 1 view.
Figure 2:
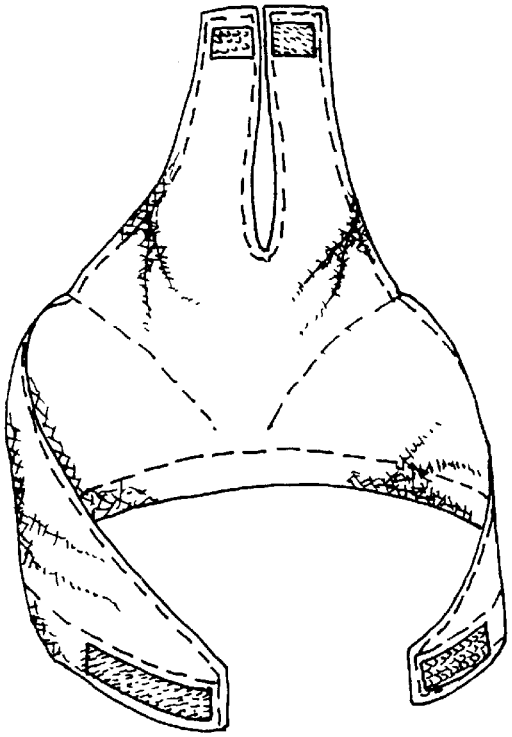
FIG. 2 is a perspective view of a preferred embodiment of the three-cornered head covering of FIG. 1 with the head covering unfastened.

Referring now to FIGS. 1, 2 and 3, a head covering (10) built in accordance with the present invention is shown. The head covering (10) is made of a flexible material (12) which can be folded around the head (14) of the wearer. The flexible material includes three corners (20, 22 and 24). A first portion (18), also called the head band portion, of the head covering is formed between the first corner (20) and the second corner (22). The head covering (10) is worn by the wearer by wrapping the first portion (18) of the head covering (10) around the sides of the head (14) and connecting the two corners (20) and (22) in the back of the head (16). In a preferred embodiment the connection of the first corner (20) and the second corner (22) is made using a hook and loop fastener.

The third corner (24) of the head covering is pulled over the top of the head (14) toward the back of the head (16) and is connected to the first portion (18) of the head covering (10). A second portion (19) of the head covering (10) is formed between the first portion (18) and the third corner (24). When the third corner (24) is connected to the first portion (18) as described above, the second portion (19) of the head covering (10) will be snugly wrapped over the top of the wearer's head (14). In a preferred embodiment, the connection of the third corner (24) of the first portion (18) of the head covering (10) is made using a hook and loop fastener.

This corner (24) is split into parts (24*a*) and (24*b*) providing an opening (24*c*) to receive a pony tail (15).

To facilitate a clear understanding of how the head covering (10) of the present invention is worn, it should be noted that the flexible material (12) includes an inside surface and an outside surface. The inside surface is defined as the surface worn against the head. The outside surface is the side opposite of the inside surface. The outside surface is the side opposite of the inside surface. The outside surface of the head covering (10) is shown in FIGS. 1, 2 and 3.

Also as shown in FIGS. 1–4, the first portion (18) of the head covering (10) includes the first corner (20) and the second corner (22). Similarly, the second portion (19) of he head covering (10) includes the third corner (24). Thus, as described above, when the third corner (24) is connected to the first portion (18), it can be connected to the outside surface of the second corner (22) whereas the inside surface of the second corner (22) is connected to the outside surface of the first corner (20). The third corner (24) is split into two parts (24*a*) and (24*b*), so that a pony tail can extend out opening (24*c*).

Figure 4:
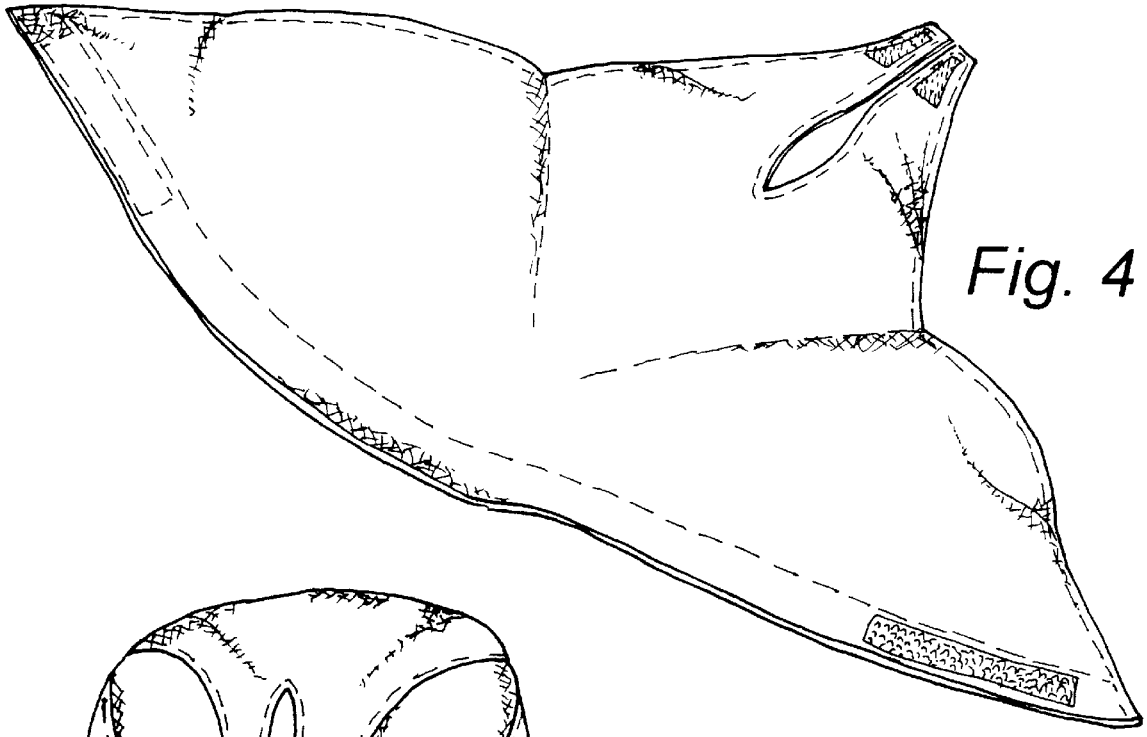
FIG. 4 is a perspective view showing the embodiment of FIGS. 1–3 unfastened.

Referring now to FIG. 4, the head covering (10) of the present invention is shown in an unfastened position. The inside surface of the head covering (10) is shown. As can be seen in the present view, the flexible material need not be a triangle. The material (12) can be a compilation of several pieces of flexible material connected together by sewing in a preferred method. the flexible material member (12) can be made in a wide variety of shapes to create various looks and first when worn on the head by the wearer. Additionally, although not shown, the shape of the material can be made such that the material (12) will include more than three corners. Also, the three corners required by the present invention need not be actual corners but can also be defined as the three positions in which the fasteners are placed. These various embodiments should all be considered within the scope of the present invention as claimed below.

Figure 5:
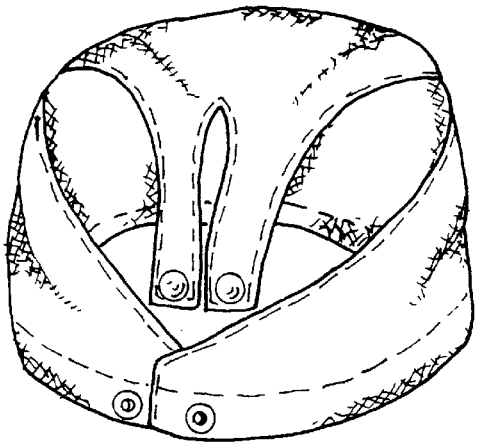
FIG. 5 is a perspective view showing another type of embodiment of the three-cornered head covering using snaps.

In another embodiment of the present invention as shown in FIG. 5, the first portion (18) of the head covering (50) could be constructed to include snaps (26, 27, 28 and 29). Other types of fasteners could be used instead of snaps.

Figure 6:
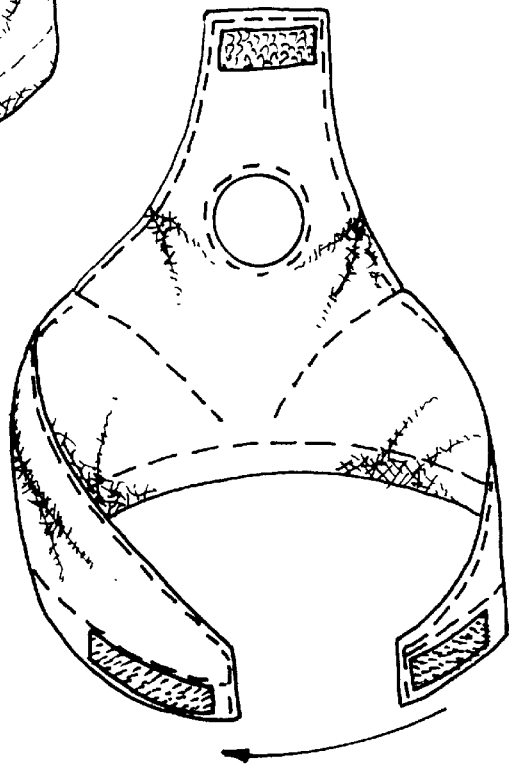
FIG. 6 is a perspective view of yet another type of embodiment of the three-cornered head covering with the first corner folded toward the second corner and the top not yet fastened to the back.

Referring to FIG. 6, head covering (100) is a modification of the embodiments of FIGS. 1–5 described above. A first corner (120) and a second corner (122) include the same type of fastener component (170), that is, both fasteners could have the hook component or both could have the loop component. The third corner (124) could then have one continuous fastener (180) to satisfy the complementary fastener to both the first and the second corner fasteners (170).

In the embodiments described for FIG. 6, pony tail opening (125) is disposed in third corner (124). The wearer puts the pony tail (15) through opening (125) and then wraps the first corner (120) and the second corner (122) around the sides of the head (14) and holds them in close proximity to each other at the back of the head (16). The wearer then wraps the third corner (124) over the top of the head and connects it to the first corner (120) and the second corner (122). The first corner (120) and the second corner (122) are held in place with respect to each other by the connection to the third corner (124).

The head covering (10) as shown in FIGS. 1–6 can be adjusted to fit different head sizes by varying the overlap of the first corner and the second corner. Thus, if the wearer of the head covering desires to have a tighter fit, the wearer would simply create more overlap of the corners, thereby creating a tighter fit around the sides of the wearer's head.

Obviously, many modifications and variations of the present invention are possible in light of the above teachings. It is therefore to be understood that, within the scope of the appended claims, the invention may be practiced otherwise than as specifically described.

I claim:

1. A head covering consisting of:

a flexible material member, said flexible material member including: an outside surface, an inside surface; a first corner; a second corner; a third corner; a first portion disposed in a generally straight line fashion between said first corner and said second corner and including said first corner and said second corner; and a second portion projecting upwardly from said first portion and including said third corner;

a first connecting means for connecting said first corner to said second corner;

a second connecting means for connecting said third corner to said first portion, wherein said first portion and said second portion cooperate with one another to generally cover that portion of the user's head which is disposed above said first portion;

an opening in said second portion and adjacent said third corner for receiving a pony tail therethrough; and wherein said third corner is split into a first half and a second half and said opening for a pony tail is disposed therebetween.

2. The head covering of claim 1 wherein said first connecting means includes a hook component and a loop component.

3. The head covering of claim 1 wherein said second connecting means includes a hook component and a loop component.

4. The head covering of claim 1:

wherein said first connecting means includes a hook component and a loop component; and wherein said second connecting means includes a hook component and a loop component.

5. The head covering of claim 4:

wherein one of said hook component and said loop component of said first connecting means is disposed on the inside surface of said first corner;

wherein the other of said hook component and said loop component of said first connecting means is disposed on the outside surface of said second corner;

wherein one of said hook component and said loop component of said second connecting means is disposed on the inside surface of said third corner; and wherein the other of said hook component and said loop component of said second connecting means is disposed on the outside surface of said first portion.

* * * * *